US006394063B1

(12) United States Patent
Volz et al.

(10) Patent No.: US 6,394,063 B1
(45) Date of Patent: May 28, 2002

(54) METHOD FOR OPERATING AN INTERNAL COMBUSTION ENGINE

(75) Inventors: Dieter Volz, Heilbronn; Ernst Wild, Oberriexingen; Werner Mezger, Eberstadt; Juergen Pantring, Schwieberdingen; Andreas Roth, Muehlacker-Lomersheim; Franco Baiocchi, Munich; Roland Herynek, Oetisheim; Mirjam Steger, Vaihingen; Gudrun Menrad; Lutz Reuschenbach, both of Stuttgart; Michael Oder, Illingen; Werner Hess, Stuttgart; Georg Mallebrein, Korntal-Muenchingen; Christian Koehler, Erligheim, all of (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/582,823

(22) PCT Filed: Nov. 2, 1999

(86) PCT No.: PCT/DE99/03476

§ 371 (c)(1),
(2), (4) Date: Aug. 2, 2000

(87) PCT Pub. No.: WO00/26526

PCT Pub. Date: May 11, 2000

(30) Foreign Application Priority Data

Nov. 3, 1998 (DE) ..... 198 50 586

(51) Int. Cl.[7] ..... F02B 17/00

(52) U.S. Cl. ..... 123/295; 701/104

(58) Field of Search ..... 123/295, 305; 701/101, 102, 103, 104, 105

(56) References Cited

U.S. PATENT DOCUMENTS

| | | | | |
|---|---|---|---|---|
| 5,954,023 A | * | 9/1999 | Mizuno et al. | 123/295 |
| 5,975,045 A | * | 11/1999 | Mizuno | 123/295 |
| 6,029,622 A | * | 2/2000 | Kadota et al. | 123/295 |
| 6,085,717 A | * | 7/2000 | Kamura et al. | 123/295 |
| 6,125,816 A | * | 10/2000 | Inoue | 123/295 |
| 6,256,576 B1 | * | 7/2001 | Wild et al. | 123/295 |

FOREIGN PATENT DOCUMENTS

| | | | |
|---|---|---|---|
| DE | 19650518 C1 | * | 6/1998 |
| DE | 196 50 518 | | 6/1998 |
| EP | 0833044 A2 | * | 4/1998 |
| EP | 0833044 | | 4/1998 |
| FR | 2752267 | | 2/1998 |
| FR | 2752267 A1 | * | 2/1998 |

* cited by examiner

*Primary Examiner*—Willis R. Wolfe
(74) *Attorney, Agent, or Firm*—Walter Ottesen

(57) ABSTRACT

An internal combustion engine especially for a motor vehicle is described which is provided with a combustion chamber into which fuel can be injected in at least two operating modes. A control apparatus is provided with which a switchover can be made between the operating modes in dependence upon a desired operating mode. The desired operating mode can be determined from a plurality of operating mode requests by the control apparatus.

12 Claims, 4 Drawing Sheets

Fig. 4

| Priority | Operating Mode Request |
|---|---|
| 1 | Monitoring |
| 2 | Component Protection |
| 3 | Emergency Operation |
| 4 | Desired Torque Adjustability and Lambda Limits |
| 5 | Heating Catalytic Converter |
| 6 | Control of Storage Catalytic Converter |
| 7 | Start/Warm Running |
| | |
| x | Operating Mode Characteristic Field |
| | Fixed Priority List |

| Priority | Operating Mode |
|---|---|
| 1 | skh |
| 2 | sch |
| 3 | hos |
| 4 | hmm |
| 5 | hom |

Fig. 5

METHOD FOR OPERATING AN INTERNAL COMBUSTION ENGINE

FIELD OF THE INVENTION

The invention relates to a method for operating an internal combustion engine especially of a motor vehicle wherein fuel is injected into the combustion chamber in at least two modes of operation and wherein a switchover between the two modes of operation is made in dependence upon a desired mode of operation. Likewise, the invention relates to an internal combustion engine, especially for a motor vehicle, having a combustion chamber into which fuel can be injected in at least two modes of operation and having a control apparatus with which a switchover between the modes of operation can be made in dependence upon a desired mode of operation.

BACKGROUND OF THE INVENTION

A method of this kind and an internal combustion engine of this kind are known, for example, from a so-called gasoline direct injection. There, fuel is injected into the combustion chamber in a homogeneous operation during the induction phase or in a stratified operation during the compression phase. The homogeneous operation is preferably provided for the full-load operation of the engine; whereas, the stratified operation is suitable for idle operation and part-load operation. For example, in a direct-injection engine of this kind, a switchover between the above-mentioned modes of operation takes place in dependence upon the wanted desired mode of operation.

This desired mode of operation results, inter alia, from the particular operating state of the engine. Thus, the homogeneous operation can be purposeful, for example, for a cold start of the engine. In contrast thereto, it is possible that, for example, the stratified operation is preferred when there is a defect. The correct desired mode of operation must be determined for the particular time point from these modes of operation of the engine.

SUMMARY OF THE INVENTION

The object of the invention is to provide a method for operating an internal combustion engine with which a flexible but nonetheless effective determination of the desired mode of operation is possible.

This object is achieved with a method of the above-mentioned type in accordance with the invention in that the desired mode of operation is determined from a plurality of operating mode requests. In an engine of the above-mentioned type, the task is solved in accordance with the invention in that the desired operating mode can be determined by the control apparatus from a plurality of operating mode requests.

Specific functions in the control apparatus are assigned to the various possible operating states of the engine. These functions can trigger operating mode requests. Like functions can be bundled together and be provided with a common operating mode request. An operating mode command can be limited to a specific wanted mode of operation but can also include several modes of operation. The operating mode requests of all functions of the engine are processed by the control apparatus. The control apparatus determines the desired mode of operation from these operating mode requests.

In this manner, a decoupling is achieved between the respective functions of the engine and the desired operating mode. This affords the advantage that the programs for the functions can be configured clearly and manageably and especially independently of each other. The functions are brought into connection with the desired operating mode only by the introduction of the operating mode requests corresponding to the functions. In this way, the possibility is provided by the invention to assign the individual functions and therefore the individual operating mode requests to respective individual programs in the control apparatus. These programs can be built up in modular fashion and thereby are simpler and more flexible to produce and to change and, at the same time, the occurrence of defects is less.

In an advantageous configuration of the invention, each of the operating mode requests is assigned a priority and the determination of the desired operating mode is carried out in dependence upon the priorities of the operating mode requirements. In this way, it is possible to weight the various operating mode requests of the engine. Especially operating mode requests which relate to specific operating states or their functions (for example, to the protection of components against destruction or to the emergency operation of the engine) can be provided with a higher priority than, for example, the cold start of the engine. This weighting can again be changed rapidly and with flexibility because of the modular-like configuration.

Preferably, the priorities for the operating mode requests are contained in a priority list stored in the control apparatus and can there be expanded at any time and/or changed.

In an advantageous embodiment of the invention, two operating mode requests are coupled to each other and the coupling result is further used when at least one coincidence is present in the two operating mode requests. The operating mode request having the higher priority is used as a connecting result when no coincidence is present in the two operating mode requests. Thereafter, the coupling result is coupled to the operating mode request having the next lower priority. Preferably, an AND coupling is carried out.

It is especially advantageous when each of the operating modes is assigned a priority and when that one of the available operating modes is selected which has the highest priority in the case that in the last-determined coupling result more than one operating mode is set.

Preferably, the priorities for the operating modes are contained in a priority list stored in the control apparatus and can there be supplemented and/or changed at any time.

In another embodiment of the invention, the operating mode requests and the desired operating mode are stored in the control apparatus in the form of binary data words. Each operating mode is represented by a specific bit in the binary data words.

The realization of the method of the invention is especially significant in the form of a control element which is provided for a control apparatus of an engine, especially of a motor vehicle. A program is stored on the control element which can be run on a control apparatus and especially on a microprocessor and is suitable for carrying out the method of the invention. In this case, the invention is realized by a program stored on the control element so that this control element, which is provided with the program, can define the invention in the same manner as the method for the execution of which the program is suitable. As a control element, especially an electric storage medium can be applied, for example, a read-only-memory.

Further features, possible applications and advantages of the invention will become apparent from the description of the embodiments of the invention which follows, which are shown in the figures of the drawing. All of the described or illustrated features define the invention themselves or in any desired combination thereof independently of their combination in the patent claims or their dependency as well as independently of their formulation or illustration in the description and/or in the drawing.

BRIEF DESCRIPTION OF THE DRAWINGS

The invention will now be described with reference to the drawings wherein:

FIG. 4 shows a priority list for the operating mode requests of the engine of FIG. 1; and, FIG. 5 shows a priority list for the operating modes of the engine of FIG. 1.

DETAILED DESCRIPTION OF THE PREFERRED EMBODIMENTS OF THE INVENTION

Figure 1:
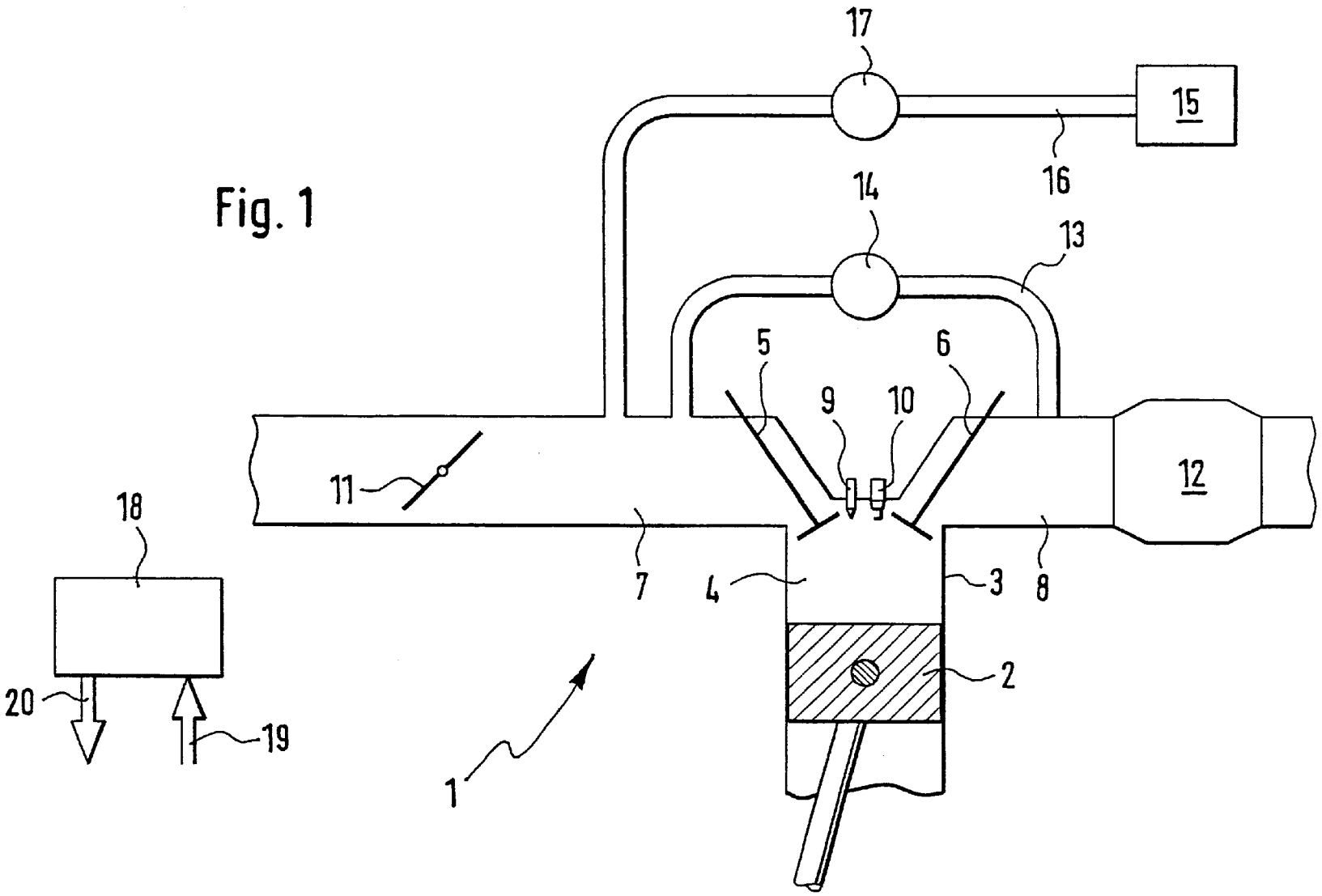
FIG. 1 shows a schematic block circuit diagram of an embodiment of the internal combustion engine of the invention.

In FIG. 1, an internal combustion engine 1 of a motor vehicle is shown wherein a piston 2 is movable back and forth in a cylinder 3. The cylinder 3 is provided with a combustion chamber 4 which, inter alia, is delimited by the piston 2, an inlet valve 5 and an outlet valve 6. An intake manifold 7 is coupled to the inlet valve 5 and the outlet valve 6 is coupled to an exhaust-gas pipe 8.

An injection valve 6 and a spark plug 10 project into the combustion chamber 4 in the region of the inlet valve 5 and the outlet valve 6. Fuel can be injected into the combustion chamber 4 via the injection valve 9. The fuel can be ignited in the combustion chamber 4 with the spark plug 10.

A rotatable throttle flap 11 is accommodated in the intake manifold 7 and air can be supplied via the throttle flap 11 into the intake manifold 7. The quantity of the supplied air is dependent upon the angular position of the throttle flap 11. A catalytic converter 12 is accommodated in the exhaust-gas pipe 8. The catalytic converter 12 serves to clean the exhaust gases arising because of the combustion of the fuel.

An exhaust-gas return pipe 13 leads from the exhaust-gas pipe 8 back to the intake manifold 7. An exhaust-gas return valve 14 is accommodated in the exhaust-gas return pipe 13. The quantity of the exhaust gas returned into the intake manifold 7 can be adjusted by the exhaust-gas return valve 14. The exhaust-gas return valve 13 and the exhaust-gas return valve 14 form a so-called exhaust-gas return.

A tank-venting line 16 leads from a fuel tank 15 to the intake manifold 7. A tank-venting valve 17 is accommodated in the tank-venting line 16. The quantity of the fuel vapor supplied from the fuel tank 15 to the intake manifold 7 can be adjusted by the tank-venting valve 17. The tank-venting line 16 and the tank-venting valve 17 form a so-called tank venting.

A back and forth movement is imparted to the piston 2 by the combustion of the fuel in the combustion chamber 4. This movement is transmitted to a crankshaft (not shown) and applies a torque to the crankshaft.

Input signals 19 are applied to a control apparatus 18 and these signals define operating variables of the engine 1 measured by means of sensors. For example, the control apparatus 18 is connected to an air-mass sensor, a lambda sensor, an rpm sensor and the like. Furthermore, the control apparatus 18 is connected to an accelerator pedal sensor which generates a signal indicating the position of an accelerator pedal actuated by a driver and therefore the torque requested. The control apparatus 18 generates output signals 20 with which the performance of the engine 1 can be influenced via actuators and positioning devices. For example, the control apparatus 18 is connected to the injection valve 9, the spark plug 10 and the throttle flap 11 and the like and generates the signals required for driving the latter.

The control apparatus 18 is, inter alia, provided to open-loop control and/or closed-loop control the operating variables of the engine 1. For example, the fuel mass is open-loop controlled and/or closed-loop controlled by the control apparatus 18 especially with regard to a low consumption of fuel. For this purpose, the control apparatus 18 is provided with a microprocessor which has a program stored in a storage medium (especially in a read-only-memory). The program is suitable to execute the above-mentioned open-loop control and/or closed-loop control.

In a first operating mode, a so-called homogeneous operation "hom" of the engine 1, the throttle flap 11 is partially opened or partially closed in dependence of the desired torque. The fuel is injected into the combustion chamber 4 during an induction phase caused by the piston 2. The injected fuel is swirled by the air inducted at the same time via the throttle flap 11 and is thereby essentially uniformly distributed in the combustion chamber 4. Thereafter, the air/fuel mixture is compressed during the compression phase in order to be then ignited by the spark plug 10. The piston 2 is driven by the expansion of the ignited fuel. The torque which occurs is dependent essentially on the position of the throttle flap 11 in the homogeneous operation. The air/fuel mixture is adjusted as close as possible to lambda=1 or lambda<1 with a view to a reduced development of toxic substances.

In a second mode of operation, a so-called homogeneous lean operation "hmm" of the engine 1, the fuel is injected into the combustion chamber during the induction phase as in the homogeneous operation. In contrast to the homogeneous operation, the air/fuel mixture can, however, also occur at lambda>1.

In a third operating mode, a so-called stratified operation "sch" of the engine 1, the throttle flap 11 is opened wide. The fuel is injected into the combustion chamber 4 by the injection valve 9 during a compression phase caused by the piston 2 and this injection is spatially in the direct vicinity of the spark plug 10 as well as at a suitable time distance ahead of the ignition time point. Then, with the aid of the spark plug 10, the fuel is ignited so that the piston 2 is driven in the following working phase by the expansion of the ignited fuel. In stratified operation, the arising torque is dependent substantially on the injected fuel mass. The stratified operation is essentially provided for the idle operation and for the part-load operation of the engine 1.

In a fourth mode of operation, a so-called homogeneous-stratified operation "hos" of the engine 1, a double injection takes place. Fuel is injected into the combustion chamber 4 by the injection valve 9 during the induction phase and during the compression phase. The homogeneous-stratified operation thereby couples the characteristics of the stratified operation and of the homogeneous operation. For example, an especially soft transition from the stratified operation into the homogeneous operation and vice versa is achieved with the aid of the homogeneous-stratified operation.

In a fifth mode of operation, a so-called stratified catalytic converter heating "skh" of the engine 1, a double injection likewise takes place. Fuel is injected into the combustion chamber 4 by the injection valve 9 during the compression phase and during the working phase. In this way, essentially no additional torque is achieved; instead, a rapid warming of the catalytic converter 12 is effected by the fuel injected in the working phase. This is especially of significance for a cold start of the engine 1.

A switching back and forth and/or a switchover can be made between the described operating modes of the engine 1. Switchovers of this kind are carried out by the control apparatus 18. The triggering of a switchover takes place via the individual functions of the engine 1. For example, for a cold start, the fifth mode of operation (namely, the stratified catalytic converter heating) can be requested with which the catalytic converter 12 is heated rapidly to an operating temperature.

In the engine 1, a plurality of such functions is provided which all request a specific mode of operation of the engine 1 and therefore trigger, as needed, a switchover between the modes of operation. These requests from the various functions must be matched to each other and be coordinated so that only switchovers are carried out which are absolutely necessary.

Figure 2:
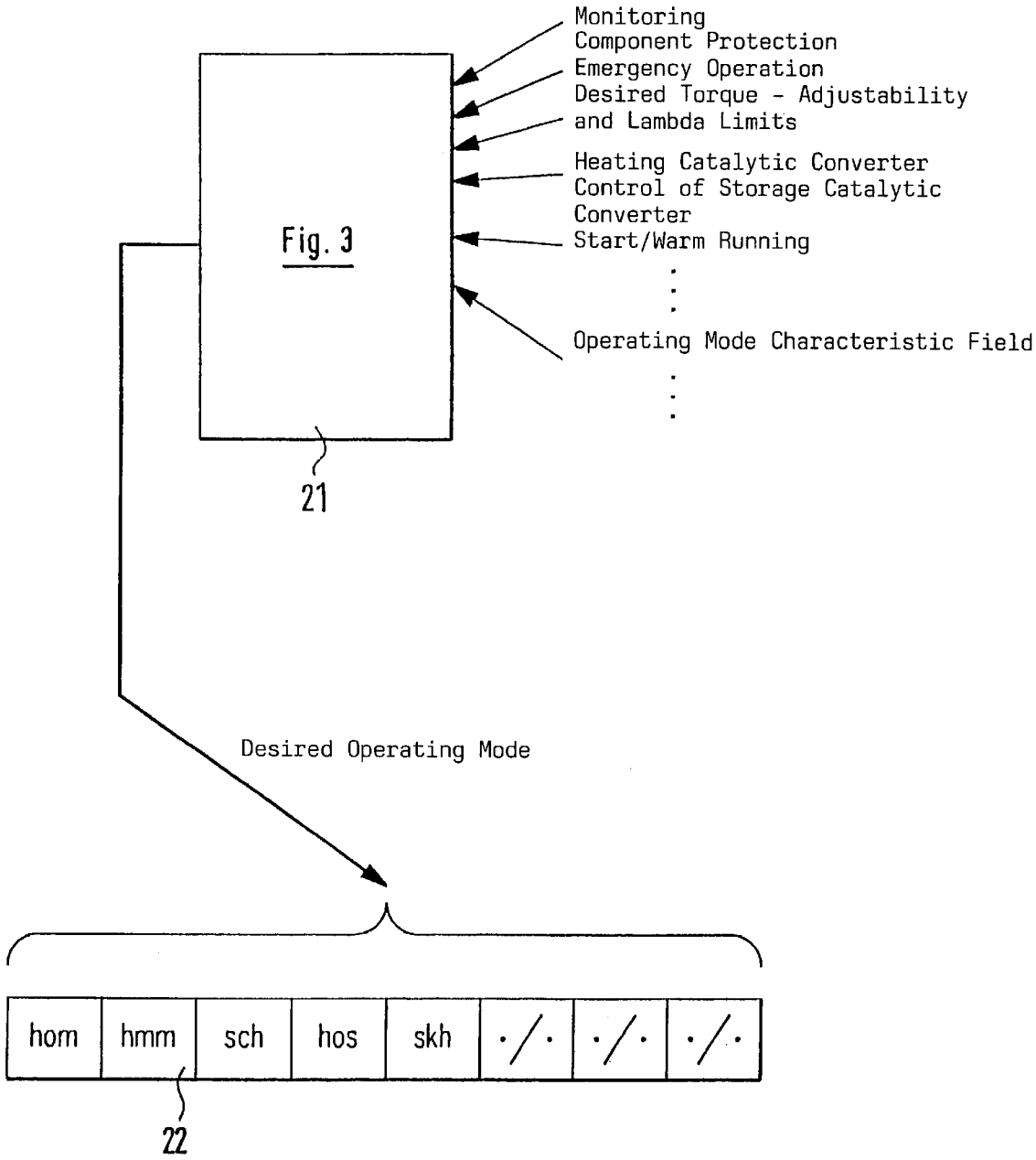
FIGS. 2 and 3 show a schematic block circuit diagram and a schematic sequence diagram, respectively, of an embodiment of the method of the invention for the operation of the internal combustion engine of FIG. 1.
Figure 3:
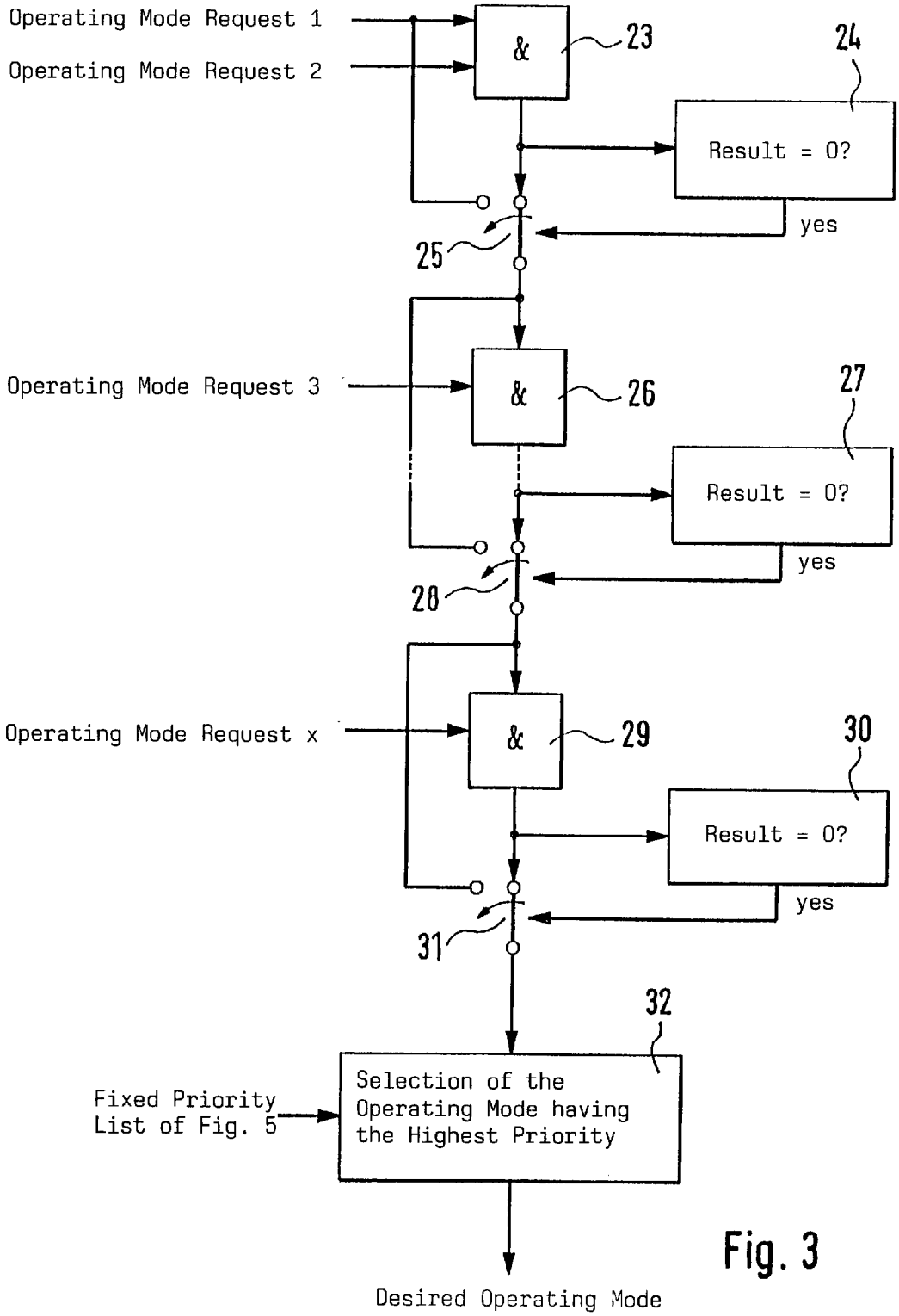

A method is shown in FIGS. 2 and 3 which can be executed by the control apparatus 18 and which is suitable for coordinating the requests of the modes of operation by various functions of the engine 1. The block 21 shown in FIG. 2 defines a space holder for the method of FIG. 3. The method of FIG. 3 is represented in the control apparatus 18 especially by modular-like built-up programs.

According to FIG. 2, a plurality of functions applies to block 21. This can be seen from the plurality of arrows directed toward the block 21 and shown in the right-hand side.

The above relates to a monitoring of the engine 1. In this way, it is ensured that the engine 1 never generates a torque higher than requested. Furthermore, the above relates to the protection of a component. In this way, it is, for example, ensured that the temperature of the exhaust-gas pipe 8 never becomes so high that damage of the exhaust-gas pipe 8 or of the catalytic converter 12 need be feared. The above also relates to an emergency operation of the engine 1. With this function, it is ensured that the engine 1 can be operated, under specific conditions, in the stratified operation but not in homogeneous operation. Further, the above relates to the adjustability of the desired torque of the engine 1 and the maintenance of wanted lambda limits. Furthermore, the above relates to the means of the catalytic converter heating, which is executed by means of the already described fifth mode of operation, with which the catalytic converter 12 is rapidly heated especially for a cold start of the engine. Furthermore, the above relates to a control of a storage catalytic converter, which is accommodated in the catalytic converter as required and which is provided for the intermediate storage of nitrogen oxides. This function ensures that the storage catalytic converter is again timely discharged after a charging. Furthermore, the above relates to the function of the start and/or warm running wherein the engine 1 may not be operated, for example, in the operating mode of the stratified operation. Furthermore, the above relates to an operating mode characteristic field which is provided for the normal driving operation. Furthermore, a plurality of other functions can be provided which charge the block 21.

In FIG. 2, a desired byte 22 is shown which serves for the storage of the described operating modes of the engine 1 in the control apparatus 18. The desired byte 22 has eight bits of which three bits are not occupied. At this location it is noted that the engine 1, which is described with respect to FIG. 1, and the method, which is described with respect to FIGS. 2 and 3, can also be carried out with fewer or with more than five different modes of operation. In this case, more or fewer bits are not occupied in the desired byte 22.

The homogeneous operation "hom", the homogeneous lean operation "hmm", the stratified operation "sch", the homogeneous-stratified operation "hos" and the stratified catalytic converter heating "skh" are each represented by one of the remaining five bits.

The desired byte 22, which is shown in FIG. 2, is provided to characterize the desired operating mode, that is, the desired mode of operation of the engine 1. If the engine 1 is to be operated, for example, in the homogeneous operation as wanted desired mode of operation, then the bit "hom" is set to "1" in the desired byte 22; whereas, the other four relevant bits are all set to "0". In the desired byte 22, always one of the relevant bits is thereby set to "1"; whereas, the other bits are set to "0". The bit, which is set to "1", then characterizes the wanted desired operating mode of the engine 1.

The desired byte 22 and especially the desired mode of operation set therein is determined by the block 21 based on the method shown in FIG. 3.

In the method of FIG. 3, the premise is taken that the different described functions place respective operating mode requests on the block 21. These operating mode requests are transmitted from each of the operating states to the block 21 with each request having a request byte corresponding to the desired byte 22. The individual bits in the request byte correspond to the respective bits of the desired byte 22.

At least one bit in the request byte is set to "1". However, all five bits can be set. In the first case, this means that the corresponding function requests only this operating mode specific to the set bit. In the other case, it is inconsequential for the corresponding function which mode of operation is present. The corresponding function therefore possibilities, which lie therebetween are likewise permissible. Accordingly, for example, one function can request the homogeneous operation independently of the lambda value which is to be adjusted. In this case, the bit for "hom" and for "hmm" are each set to "1" in the corresponding request byte. The remaining bits are, however, set to "0".

The desired byte 22 and the request byte are binary data words which are stored in the control apparatus 18 and in which each operating mode is represented by a specific bit. It is to be noted that the desired byte 22 and the request bytes (as described) have different meanings and must therefore be distinguished carefully from each other.

In FIG. 4, a priority list for the operating mode requests of the various functions is given. The operating mode request of the function "monitoring" has the highest priority "1" and the operating mode request of the function "component protection" has the next lower priority "2", et cetera. After the operating mode request of the function "start/warm running" having the priority "7", a plurality of further functions can follow with corresponding lower-order priorities. Finally, the operating mode request of the function "operating mode characteristic field" is provided as the next-to-last function having the priority "1". Thereafter, a fixed priority list for the described operating modes follows having the lowest priority.

The functions having the highest priorities are concerned with special cases; whereas, the function "operating mode characteristic field" is concerned with the normal operation of the engine 1. The special cases are provided with a higher priority so that they can intervene relative to the normal case. The priority list for the operating modes is arranged below the function "operating mode characteristic field" and is explained in greater detail hereinafter.

According to FIG. 3, the operating mode request of the priority "1" (that is, the operating mode request of the function "monitoring") is AND coupled in a coupling location 23 with the operating mode request having the priority "2", (that is, the operating mode request of the function "component protection"). For this purpose, the respective corresponding request bytes from the control apparatus 18 are AND coupled.

If the function "monitoring", for example, requests the operating mode "sch" and the operating modes "hom" or "hmm" are requested by the function "component protection", then this results in the following AND coupling of the corresponding request bytes: 00001000 AND 00000011. The coupling result of this AND coupling is 00000000. In this way, it would not be possible to select a desired operating mode.

For this reason, the coupling result is compared to "0" by a block 24. If the comparison is positive, then a switch 25, which is arranged downstream of the coupling element 23, is switched over. In this way, the coupling result of the coupling element 23 is no longer transmitted further and, instead, the operating mode request having the higher priority "1" is transmitted further as the coupling result.

If the function "monitoring", for example, requests the operating mode "hom" and the function "component protection" requests the operating mode "hom" or "hmm", then this results in the following AND coupling of the corresponding request bytes: 00000001 AND 00000011. The coupling result of this AND coupling is 00000001.

This coupling result is unequal to "0" so that the switch 25 is not switched over and the coupling result is transmitted unchanged.

The particular coupling result is transmitted to a further coupling element 26 whereat it is AND coupled to the operating mode request having the priority "3", that is, the operating mode request of the function "emergency operation". The coupling result is compared in a corresponding manner to "0" by a block 27 in order to switch over a switch 28 in dependence thereon.

This method is continued with the operating mode requests of all functions in a series sequence corresponding to the priorities given in the priority list of FIG. 4 until the operating mode request having the priority "x" is reached, that is, the operating mode request of the function "operating mode characteristic field".

The basis of the function "operating mode characteristic field" is a characteristic field wherein the torque, which is requested by the engine 1, is plotted against the rpm thereof. At each point of this characteristic field, a request byte is stored wherein it is given in which operating mode the engine 1 should generate the requested torque. Each of these request bytes thereby contain only a single set bit.

The corresponding request byte is given as an operating mode request having the priority "x" to a coupling element 29 in S dependence upon the requested torque and the rpm of the engine 1 in order to there be AND coupled to the last generated coupling result. The coupling result is compared to "0" by a block 30 in the manner already described in order to switch over a switch 31 in dependence thereon.

In the coupling result which is now present and which is generated by the coupling element 29, one or several bits can be set.

If, for example, the operating mode "hmm" is set in the request byte of the function "operating mode characteristic field", but, for example, the operating modes "sch" and "hos" are set in the coupling result supplied to the coupling element 29, then, the switch 31 is switched over and the coupling result which is supplied to the coupling element 29 is transmitted further. This coupling results reads as follows: 00001100.

The coupling result (that is, in the above example, the coupling result 00001100), which is generated by the coupling element 29, is supplied to a block 32 in accordance with FIG. 3 wherein that one of the set operating modes having the highest priority is selected from the coupling result.

In FIG. 5, a priority list of the operating modes of the engine 1 is shown. The above-mentioned selection of that operating mode having the highest priority is based on this priority list. In the above example, the operating mode "sch" is selected as the operating mode having the highest priority from the coupling result.

In this way, the desired byte 22 of FIG. 2 results as the output signal of the block 32 and therefore as the desired operating mode. In this desired byte 22, and as already mentioned, only a single bit is set. In the above example, the desired byte reads 00001000 and characterizes the stratified operation "sch" as desired operating mode.

What is claimed is:

1. A control element including a read-only-memory for a control apparatus of an internal combustion engine including an engine for a motor vehicle, the control element comprising a program is stored thereon which can be run on a control apparatus including a microprocessor for carrying out a method including the steps of: injecting fuel into a combustion chamber of said engine in at least two operating modes; switching between said operating modes in dependence upon a desired operating mode; and, determining said desired operating mode from a plurality of operating mode requests triggered by functions of the engine.

2. An internal combustion engine including an engine for a motor vehicle, the engine comprising:

a combustion chamber;

means for injecting fuel in at least two modes of operation;

a control apparatus for switching over between the operating modes in dependence upon a desired operating mode;

means for detecting the desired operating mode from a plurality of operating mode requests by the control apparatus; and, the operating mode requests and the desired operating mode being stored in the form of binary data words in the control apparatus and each operating mode being represented by a specific bit in the binary data words.

3. A method of operating an internal combustion engine including an engine of a motor vehicle, the method comprising the steps of:

injecting fuel into a combustion chamber of said engine in at least two operating modes;

switching between said operating modes in dependence upon a desired operating mode; and, determining said desired operating mode from a plurality of operating mode requests triggered by functions of the engine.

4. The method of claim 3, comprising the further steps of assigning a priority to each of the operating mode requests; and, determining the desired operating mode in dependence upon the priorities of the operating mode requests.

5. An internal combustion engine including an engine for a motor vehicle, the engine comprising:

a combustion chamber;

means for injecting fuel in at least two modes of operation;

a control apparatus for switching over between the operating modes in dependence upon a desired operating mode; and, means for detecting the desired operating mode from a plurality of operating mode requests triggered by functions of the engine processed by the control apparatus.

6. The internal combustion engine of claim 5, wherein a priority list of the operating mode requests is stored in the control apparatus.

7. The internal combustion engine of claim 5, wherein a priority list of the operating modes is stored in the control apparatus.

8. A method of operating an internal combustion engine including an engine of a motor vehicle, the method comprising the steps of:

injecting fuel into a combustion chamber of said engine in at least two operating modes;

switching between said operating modes in dependence upon a desired operating mode;

determining said desired operating mode from a plurality of operating mode requests;

coupling two operating mode requests with each other to obtain a coupling result; and, further using said coupling result when at least one coincidence is present in the two operating mode requests.

9. The method of claim 8, wherein the operating mode request having the higher priority is used further as a coupling result when no coincidence is present in the two operating mode requests.

10. The method of claim 8, comprising the further step of coupling the coupling result having the operating mode request to the next lower priority.

11. The method of claim 8, wherein an AND coupling is carried out.

12. The method of claim 8, comprising the further steps of assigning each of the operating modes a priority; and, in the case that more than one operating mode is set in the last determined coupling result, selecting that one of the available operating modes which has the highest priority.

* * * * *